US005940426A

United States Patent [19]

Dratner et al.

[11] Patent Number: 5,940,426

[45] Date of Patent: Aug. 17, 1999

[54] ADAPTER DEVICE FOR COMPOSITE ELECTRODES WITH AN AUXILIARY REACTANCE FUNCTION ON ELECTRIC ARC FURNACES

[75] Inventors: Johannes Dratner, Castrop Rauxel, Germany; Gianni Gensini, Buia, Italy

[73] Assignee: Danieli & C. Officine Meccaniche SpA, Buttrio, Italy

[21] Appl. No.: 08/805,664

[22] Filed: Feb. 27, 1997

[30] Foreign Application Priority Data

Feb. 29, 1996 [IT] Italy ..... UD96A0028

[51] Int. Cl.[6] ..... H05B 7/06

[52] U.S. Cl. ..... 373/93; 373/82

[58] Field of Search ..... 737/93; 313/32; 373/103, 82

[56] References Cited

U.S. PATENT DOCUMENTS

| | | | |
|---|---|---|---|
| 4,451,926 | 5/1984 | Hogg, Jr. et al. | 373/93 |
| 4,468,783 | 8/1984 | Bauer et al. | 373/93 |
| 4,532,634 | 7/1985 | Taube et al. | 373/93 |
| 4,559,630 | 12/1985 | Maes | 373/93 |
| 4,639,928 | 1/1987 | Conradty et al. | 373/93 |

FOREIGN PATENT DOCUMENTS

| | | |
|---|---|---|
| 063711 | 11/1982 | European Pat. Off. . |
| 079304 | 5/1983 | European Pat. Off. . |
| 2087699 | 5/1982 | United Kingdom . |

*Primary Examiner*—Teresa Walberg
*Assistant Examiner*—Quang Van
*Attorney, Agent, or Firm*—Antonelli, Terry, Stout & Kraus, LLP

[57] ABSTRACT

Adapter device for composite electrodes having an auxiliary reactance function on electric arc furnaces, the furnace being able to be of a type fed with direct current or alternating current and comprising at least one secondary supply circuit which connects a transformer (13) to one or more electrode-holder arms (16), the adapter comprising a hollow cylindrical metallic body (21) associated with the relative electrode-holder arm (16) and directed towards the inside of the furnace, the metallic body (21) being connected at its lower end to a graphite segment (24), directed towards the bath of molten metal, at least part of the the adapter (20) including a conductive portion (30) which is made of a highly conductive material and is solidly associated with the metallic body (21) and is dimensioned according to the desired value of overall reactance of the secondary circuit of the furnace.

22 Claims, 2 Drawing Sheets

ADAPTER DEVICE FOR COMPOSITE ELECTRODES WITH AN AUXILIARY REACTANCE FUNCTION ON ELECTRIC ARC FURNACES

BACKGROUND OF THE INVENTION

This invention concerns an adapter device for electrodes which has an auxiliary reactance function on an electric arc furnace.

To be more exact the adapter device according to the invention is applied in cooperation with composite-type electrodes commonly used on electric arc furnaces, whether those furnaces are fed with alternating current or direct current.

In the description that follows, we shall speak of reactance, even though inaccurately, even when we are referring to furnaces fed with direct current.

The state of the art covers the various problems linked to electric arc furnaces, whether those furnaces are fed with alternating current or direct current, and in particular covers the problems relating to the secondary supply circuit of the furnace.

It is known that by secondary supply circuit of a furnace is meant the part of the circuit which goes from the transformer up to the electric arc.

Where the furnace is fed with alternating current, this part comprises:

- a stationary connection between the secondary circuit of the transformer and the flexible cables, this connection being rigid and generally connected to the foundations;
- the flexible cables which connect the fixed connection with the transformer to the electrode-holder arms sand which enable the arms themselves to be moved vertically so as to alter the vertical position of the electrodes in relation to the furnace;
- the electrode-holder arms, of which there is one per each phase and which consist generally of a rigid cross-piece that can be displaced at least vertically by suitable actuation systems, the cross-piece bearing at its ends, on the one hand, the connection to the flexible cables and, on the other hand, the clamps for clamping the relative electrode;
- the electrodes, which are one per each phase and which generally consist of two or more consumable cylindrical graphite segments, from the ends of which the electric arc strikes.

When the furnace is fed with direct current, the secondary supply circuit of the furnace normally comprises, downstream of the secondary winding of the furnace transformer, a rectifier, reactors and a high-power connecting line that connects the reactors to the flexible cables associated with the single electrode-holder arm.

It is known in the art that a great component of the cost as compared to the total cost of the steel produced in a plant is represented by the quantity of graphite which constitutes the electrodes.

As the melting cycle progresses, the electrode is consumed, and it is necessary to lower the electrode progressively and to insert from above new segments in replacement to make up for that consumption.

These segments have to be processed beforehand on their outside by machine so that the clamps of the electrode-holder arms cooperate with a perfectly smooth surface in order to ensure the grip of the clamping and the correct vertical movement during the cycle.

This processing by machine entails not only a waste of material but also an appreciable increase of the unit costs of the graphite employed.

The consumption of graphite is measured in kgs/ton, that is to say, in kilograms of graphite per every ton of steel produced.

There is therefore the two-fold problem of reducing the quantity of graphite employed for embodiment of the electrodes and also of using graphite having a lower unit cost.

Another very important problem of which the manufacturers complain is the problem of ensuring an accurate balance in the three phases in furnaces fed with alternating current.

In other words, so as to obtain the best processing conditions, it is advisable to arrange that the three branches of the secondary circuit relating to the three phases have the same impedance and therefore deliver the same electric power.

This condition is necessary so as not to have imbalances in the currents circulating in the three phases with the resulting problems of overheating and creation of "hot points" in the furnace owing to an asymmetric distribution of the electric arc.

The greater the circulating currents are, the more important this problem becomes and often causes an overload in one of the external phases and a discharge in the other phases.

This occurrence which is known with the name "wild phase", leads to a lowering of the quality and efficiency of the melting and, above all, to a quick wear of the refractory material positioned on the side of the overloaded phase.

Moreover, it is especially difficult to achieve in the secondary circuit of the furnace a correct balance inasmuch as the geometric arrangement itself of the phases causes imbalances in the transmission of the power within the furnace.

Furthermore, in view of the very high value of the circulating currents, even relatively small imbalances between the different supply lines lead to great imbalances in the delivery of the power and therefore to the shortcomings mentioned above.

Besides, there exists the technological requirement of having conductors positioned as much as possible on the same plane in relation to the triangular connection which should ensure the balance of the reactances.

At the present time, to balance the phases, it is necessary to design accurately the individual components of the secondary circuit.

However, if mistakes take place in the calculation, fabrication and/or assembly of those components, such mistakes can no longer be put right without taking corrective action on the fixed part of the secondary circuit, and this entails high costs of the corrective action and long downtimes of the plant; moreover, such corrective action seldom ensures an efficient result.

In electric furnaces fed with direct current, in addition to the above problems linked to the consumption of graphite there exist further problems due to the great effect of the cost of the reactors on the overall cost of the steel produced.

PCT WO94/03028 discloses a proposal to position an additional reactor within the electrode-holder arm, thus entailing the result that the existing arms should all be replaced with heavy costs.

Furthermore, the placing of the additional reactor within the electrode-holder arms sets limits to the value of the reactor in view of the geometric limits of the arms.

Therefore, there is a substantial impossibility of placing additional reactors in pre-existing plants, for instance to increase the power delivered, without thereby entailing great modifications also to the civil works and vast and difficult operations of re-adaptation.

EP-A-0063711 describes a composite electrode comprising a cooled metallic support associated with the clamp of the electrode-bearing arm and a lower segment made of consumable graphite.

Between the metallic support and the graphite segment there is a double-layered element of heat insulation which peripherically encloses the cooling conduits which extend as far as the area where the metallic support is connected to the graphite segment.

The composite electrode as disclosed by EP'711 does not include any elements with a function of auxiliary reactance, nor does EP'711 include as a hypothesis the possibility of making this auxiliary reactance variable according to necessity.

GB-A-2 087 699 includes various solutions to achieve the connection between the metallic adapter and the graphite segment in a composite electrode for electric arc furnaces.

But this document too does not mention or include as a hypothesis the possibility of achieving an auxiliary reactance by using parts of the metallic adapter.

The adapter is achieved with a double-walled cylindrical structure, made of the same material, the only purpose of which is to define the annular cavity for the passage of the cooling fluid.

SUMMARY OF THE INVENTION

So as to overcome all these problems, of which the manufacturers in this field have complained for some time now, and also to achieve further advantages, the present applicants have designed, tested and embodied this invention.

The purpose of the invention is to provide an adapter for composite electrodes in electric arc furnaces, fed with direct current or alternating current which, apart from its primary function to support the consumable graphite segment with which it is associated, can also function as an auxiliary reactor inserted into the electrical supply circuit of the furnace.

To be more exact, with reference to a furnace fed with direct current, the function of the adapter according to the invention is that of an auxiliary reactor.

With this solution, it is possible to reduce the effect on the overall cost of the specific outer components placed on the supply line and used with the function of a reactor.

Moreover, it makes possible an easy and quick installation of such auxiliary reactors, without acting in any way on components outside the electrode, and thereafter their replacement in the event of variations of their dimensioning, even in pre-existing plants, without thereby entailing any modification of the general structure of the plant.

However, in a furnace fed with alternating current, the function of the adapter according to the invention is to provide an auxiliary reactance able to balance the currents circulating in the three phases and thus reduce the shortcomings arising from the presence of an unbalanced system.

Moreover, the presence of the adapter functioning as an auxiliary reactor makes enables a smaller number of reactors to be used in series on the line of middle tension.

The secondary purpose of the invention is to embody an adapter device for electrodes which makes possible the reduction of the quantity of graphite used overall during a normal melting cycle in an electric furnace and also the reduction of the unit price of the graphite employed.

The device according to the invention consists of an adapter of a substantially standardised type which is associated with the clamps of the electrode-holder arms and to the lower end of which is anchored the terminal graphite segment from which the electric arc strikes towards the bath of molten metal.

In a preferred embodiment of the invention the adapter consists of a hollow cylindrical metallic element within which are conduits for the circulation of a cooling fluid, generally air or water, and also conduits for the transmission of the hydraulic or pneumatic power required for the actuations within the adapter itself.

The inclusion of the adapter makes unnecessary the processing by a machine tool of the outer surface of the graphite segments since the electrode is supported at the adapter and not at the graphite segment.

This outer surface, not being processed with a machine tool, has properties of greater hardness and less porosity than those which can be achieved as a result of such processing; these improved properties are due to the greater compaction produced on the surface layer by the process of sintering the graphite segment.

This situation makes the graphite segment more resistant to oxidation and therefore less subject to being consumed during the progress of the working cycle.

The lack of this processing with a machine tool entails also a great saving of material due to the absence of processing wastes and a saving of the costs and times of the processing and also eliminates the need to have available a store for the stock of pieces already processed and ready for use.

However, the adapter according to the invention can be used also in cooperation with segments of graphite conventionally processed by machine for specific momentary availability within the Works in question.

Where the furnace is fed with direct current, the invention provides for the adapter to have the function of an additional reactor.

This function is achieved by incorporating in the adapter a replaceable conductive portion, made of material with high electric conductivity suitably dimensioned according to the specific requirements.

According to a variant, the conductive portion is associated with supporting and protecting means.

The inclusion of this additional reactor in the composite electrode makes possible a reduction of the dimension, the complexity and the problems of installation which are found with the reactors normally provided in this type of application and positioned upstream of the electrode.

By providing an adapter having a pre-defined minimum length, it is possible in this way to reduce the effect, both in terms of cost and in terms of bulk, of conventionally used reactors, since at least part of the reactive component of the supply line is incorporated into the electrode.

The inclusion of this adapter with a conductive part incorporated makes possible also the transmission of a greater quantity of power within the furnace while leaving unchanged the rest of the circuit supplying the furnace.

Moreover, the adapter according to the invention can be associated with plants already installed without any problems; this enables the required modifications to the electrical circuit to be applied without taking action on the already existing structures, by dimensioning suitably, in length and/or in thickness, the conductive part incorporated in the adapter.

Where the furnace is being fed with alternating current, the inclusion of the adapter with a conductive part incorporated can enable the problem of imbalances of the phases to be eliminated or at least reduced.

This is achieved by dimensioning suitably the conductive parts included within each adapter according to the calculations carried out during the design step, and moreover without acting on any component of the electric supply circuit located upstream of the electrode.

The invention also enables action to be taken in a properly directed manner according to the specific properties of each plant, by correcting any design imbalances of the individual phases of the secondary supply circuit of the furnace.

Moreover, the problems arising from the flicker are reduced and a better stabilisation of the arc is achieved. With a view to obtaining the functions of balance and stabilisation and also the functions of an auxiliary reactor, in one embodiment of the invention the adapter is made of a bimetallic material such as steel and copper for instance.

The variation of the reactance can thus be achieved in a desired manner by varying suitably the thickness of the two plates welded to each other.

This variation of the reactance can also be achieved, according to a variant, by changing the relative outer or inner position as between the steel portion and the copper portion.

According to a further variant the variation of the reactance is achieved by dimensioning suitably the diameter of bending of the bimetallic plate.

According to yet another variant the variation of the reactance is achieved by embodying an adapter with a substantially cylindrical metallic supporting part and a conductive part conformed as desired, for instance with a spiral, with strips, with bands, etc.

This embodiment makes it possible to obtain values of overall reactance having a very wide range, from a minimum value to a maximum value.

Furthermore, the variation of the reactance can be adjusted by acting on the length of the bimetallic plate.

The inclusion of the adapter enables the overall reactance of the circuit supplying the electrode to be increased or at least adjusted in a desired manner with a possible differentiation between the phases.

According to a variant the attachments between the adapter and the clamps of the electrode-holder arms can be replaced so as to alter the length of the travel of the electrode according to the specific requirements.

According to another variant a disk element is included between the lower end part of the adapter and the graphite segment connected thereto and ensures a reciprocal contact between the parts and thus the proper transmission of the power delivered.

This disk element can be replaced advantageously to ensure the maximum flexibility, functional nature and versatility of the electrode.

The inclusion of this disk element makes possible the limitation of the problems due to the formation of a layer of insulating oxide in the zone of contact between the graphite and the copper, especially when the graphite is very hot; this oxide is also very strong and therefore is hard to remove.

In this case the layer of oxide generally forms on the disk element, which can be replaced when the oxide has reached a pre-set value.

The adapter according to the invention also makes possible a speedy installation and replacement of the graphite segment whether the electrode is fixed to the electrode-holder arm or when the electrode is dismantled from that arm, for instance when it is located in the assembly station.

BRIEF DESCRIPTION OF THE PREFERRED EMBODIMENTS

The attached figures are given as a non-restrictive example and show some preferred embodiments of the invention as follows:—

DETAILED DESCRIPTION OF THE PREFERRED EMBODIMENTS

Figure 1:
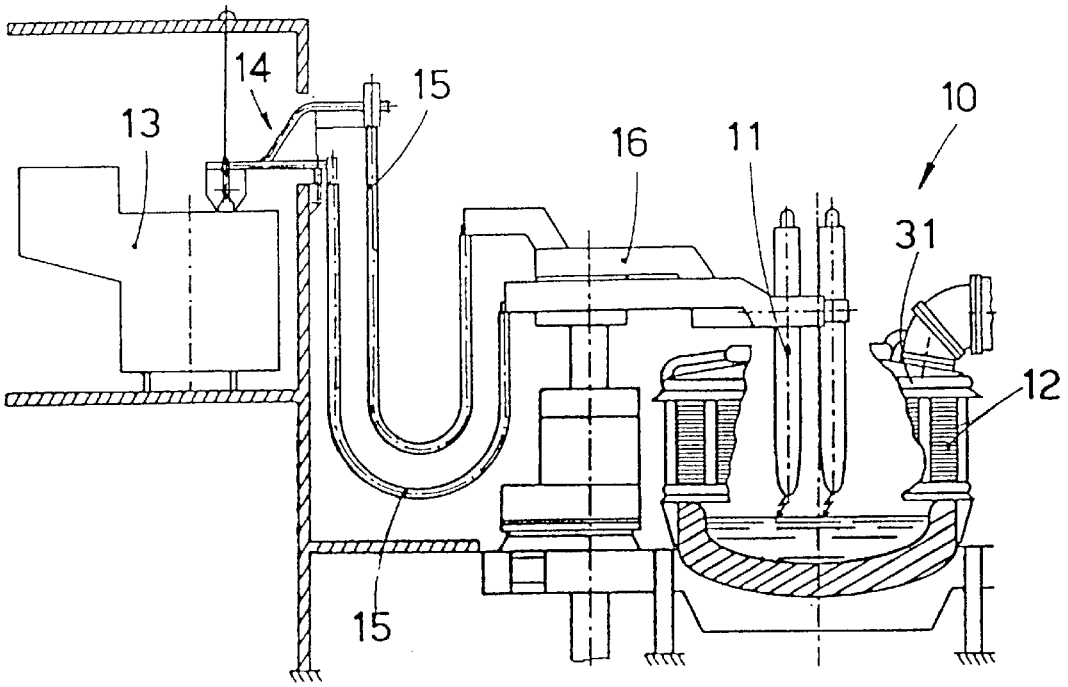
FIG. 1 shows a diagram of an electric arc furnace with a three-phase supply of alternating current.

FIG. 1 shows a diagram of an electric arc furnace 10 supplied with three-phase alternating current and including three electrodes 11 inserted within a shell 12 of the furnace 10 through a roof 31.

Figure 2:
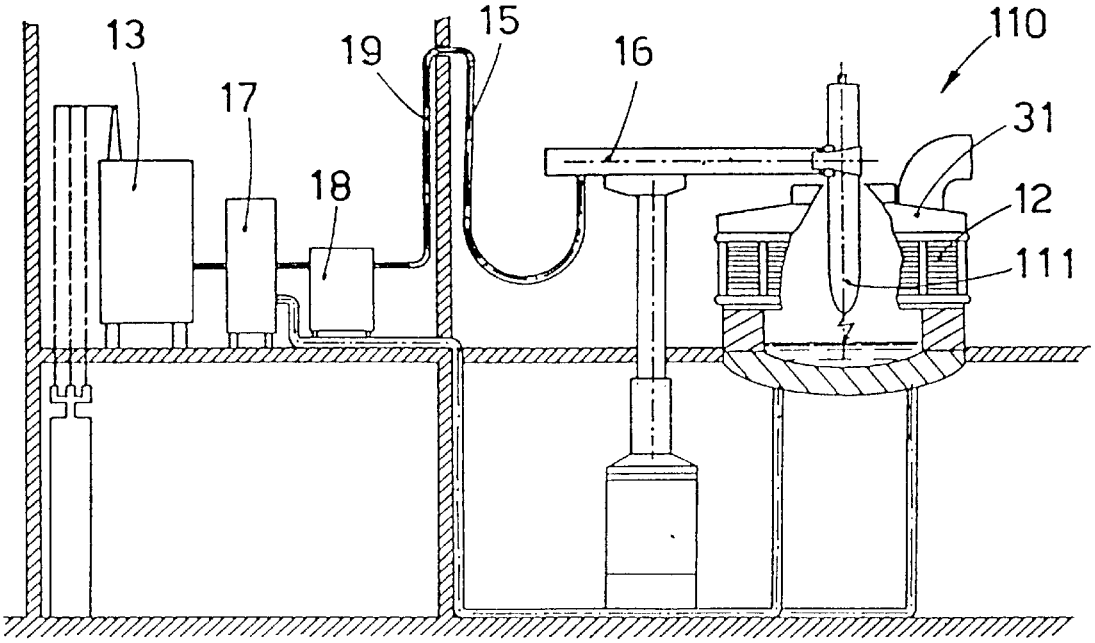
FIG. 2 shows diagrammatically and in a reduced scale an electric arc furnace with a supply of direct current.

FIG. 2 shows a furnace 110 substantially like the furnace 10 of FIG. 1 but supplied with direct current and including only one electrode 111.

The secondary supply circuit of the furnace 10 with a supply of alternating current comprises a transformer 13, a rigid connection 14 which in this case is a delta connection, flexible cables 15 and electrode-holder arms 16 which can be displaced at least vertically.

Where the furnace 110 is supplied with direct current, the secondary circuit comprises the transformer 13, a rectifier 17 and reactors 18 connected by a high power line 19 to the flexible cables 15 and to the electrode-holder arm 16.

Figure 3:
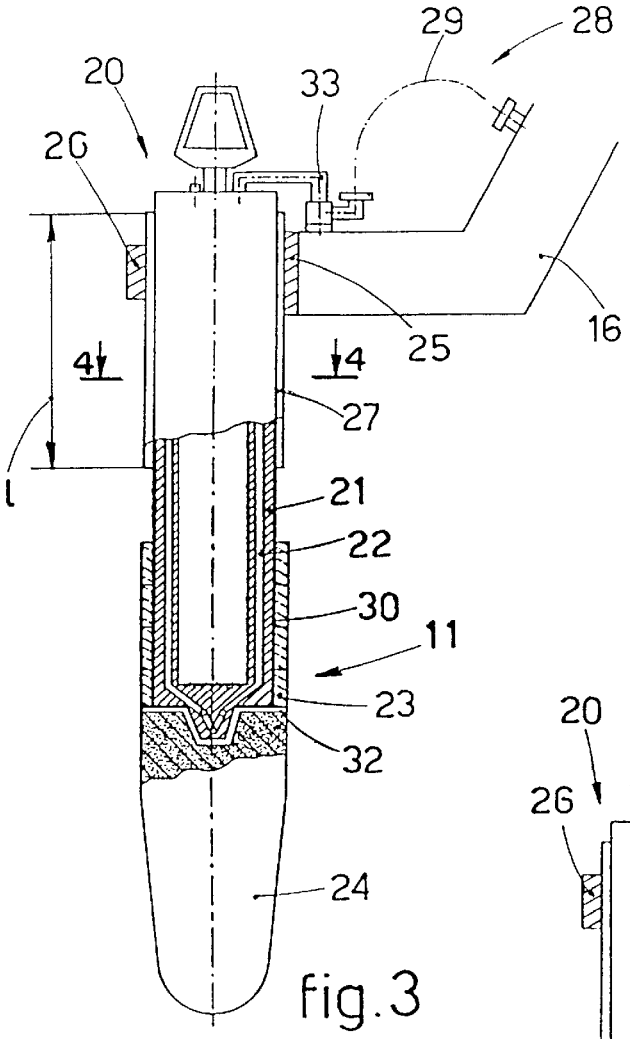
FIG. 3 shows diagrammatically an adapter device according to the invention.

An adapter device 20 according to the invention is shown with a first preferred embodiment in FIG. 3.

In this case the adapter device 20 comprises a hollow cylindrical metallic body 21 within which are included conduits 22 for circulation of a cooling fluid, either air or water.

At least the lower part of the metallic body 21 includes an outer lining 23 of a refractory material.

A graphite segment 24 is inserted in cooperation with the lower end part of the metallic body 21; the outer surface of the segment 24 does not require prior processing by a machine.

In this case a contact element 32 conformed like a disk, for instance, is included between the lower end part of the metallic body 21 and the graphite segment 24 and ensures correct transmission of the current.

This contact element 32 can be replaced advantageously to allow the cleaning from the contact surfaces of the oxides which form in the hot state and thus to ensure the correct passing of the current between the adapter and the consumable part of the electrode.

This contact element 32 acts also as a washer for assembly of the graphite segment 24 with traditional screw systems.

The metallic body 21 is supported by the electrode-holder arm 16 substantially at the upper part of the body 21 by interposition of a copper contact plate 25, which ensures transmission of the supply current.

Figure 4:
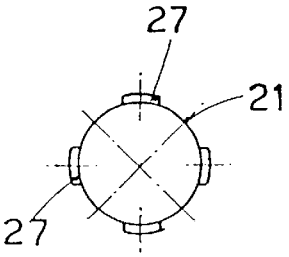
FIG. 4 shows a cross-section along the line A—A of FIG. 3.

Clamps 26 of the electrode-holder arm 16 cooperate with the metallic body 21 at attachment elements 27, which in this case are four in number and are arranged symmetrically about the circumference of the metallic body 21 (FIG. 4).

These attachment elements 27 enable the electrode 11 to be capable of being displaced vertically along a determined travel "l" and may be of a type which can be replaced either because of wear or to make that travel variably adjustable according to the specific processing requirements.

A connection means 28 is included in cooperation with the upper part of the metallic body 28 and has the task of feeding the cooling means to the metallic body 21.

This connection means 28 comprises hoses 29 that enable the cooling means to be fed to a feeder tube 33, which can be connected to the electrode-holder arm 16 or directly to the metallic body 21.

The metallic body 21 is associated with a conductive portion 30, made of a material which has a high electric conductivity, for example copper.

In the example of FIG. 3, this conductive portion 30 is located outside the lateral surface of the metallic body 21 and solidly fixed thereto.

The thickness and/or length of the conductive portion 30 may be dimensioned to define the desired value of auxiliary reactance which the adapter 20 is to have.

This embodiment with the conductive portion 30 outside the metallic body 21 is especially suitable for alternating current furnaces so as to obtain a low overall value of reactance of the adapter 20, the only function of which must be to balance the phases and possibly to reduce the number of reactors in series on the line of middle tension.

Where it is necessary to obtain a greater value of reactance in one or more of the phases so as to achieve correct balancing of the phases, the conductive portion 30 can be brought within the metallic body 21.

In this case, the conductive portion 30 and the metallic body 21 are embodied with a bimetallic structure produced with two plates welded and then pre-formed.

The balancing of the phases in an electric furnace fed with alternating current is achieved by dimensioning suitably this bimetallic structure so as to obtain the required value of reactance.

This dimensioning carried out during the design and initial calculation step can be achieved by acting on the thickness of the metallic body 21 and/or on the thickness of the conductive portion 30.

According to a variant the dimensioning of the reactance is carried out by acting on the diameter of bending of the bimetallic structure.

According to another variant the dimensioning is carried out by acting on the length of the adapter 20, or on the length of the metallic body and/or of the conductive portion 30.

According to yet another variant this dimensioning is carried out by acting on the conformation of the conductive portion 30.

In this embodiment, the plate made of highly conductive material, such as copper, can be made with a desired form such as bands, strips, a spiral, a plate with narrowed parts, etc. so as to achieve the required overall value of reactance.

Figure 5:
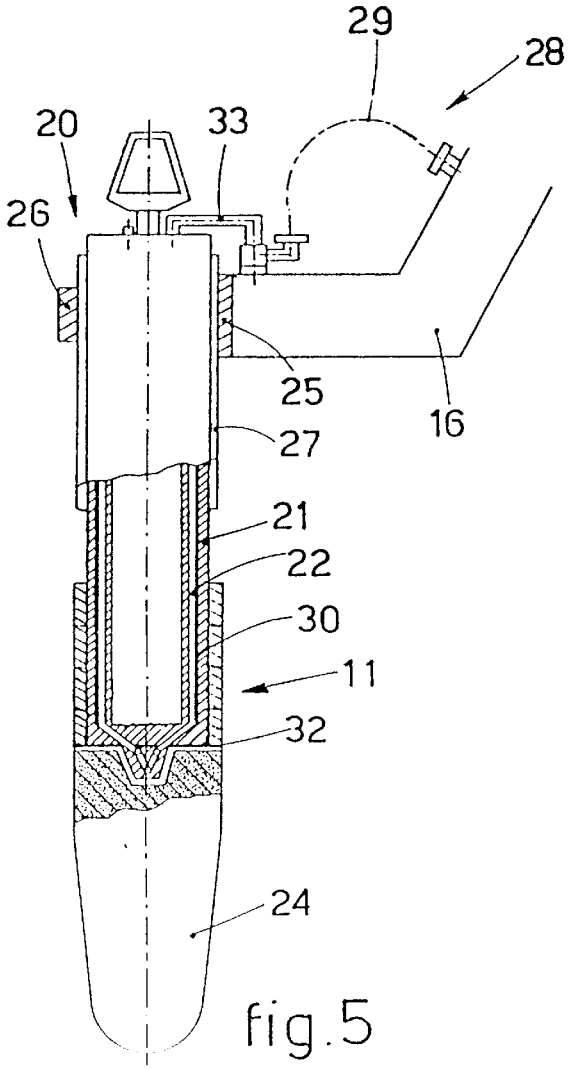
FIG. 5 shows a variant of FIG. 3.

In the example of FIG. 5 the conductive portion 30 is arranged at a protected position inside the metallic body 21.

This embodiment is preferred in furnaces supplied with direct current since in this case the purpose is to have the greatest possible value of reactance so as to increase the power delivered in the furnace.

By dimensioning this conductive portion 30 suitably, in terms of thickness, length and/or configuration, the adapter 20 can achieve the desired value of overall reactance so as to be used as an additional reactor, possibly replaceable, and thus eliminate other reactors arranged for this purpose upstream of the electrode 11.

We claim:

1. Adapter device for composite electrodes having a function of auxiliary reactance in electric arc furnaces, the furnace being a type fed with direct current or alternating current and comprising at least one secondary supply circuit which connects a transformer to one or more electrode holder-arms, the adapter comprising a hollow cylindrical metallic body associated with a relative electrode-holder arm and directed towards an inside of the furnace, the metallic body being connected at its lower end to a graphite segment directed towards a bath of molten metal inside the furnace, wherein at least part of the adapter includes a conductive portion made of a material with a high electric conductivity which is solidly associated and substantially coaxial with the metallic body, a surface of the conductive portion being dimensioned according to a desired value of overall reactance of a secondary circuit of the furnace.

2. Adapter device as in claim 1, in which at least part of the adapter comprises a bimetallic plate in iron-copper defining respectively the substantially coaxially arranged metallic body and conductive portion.

3. Adapter device as in claim 1, in which the conductive portion is located inside the metallic body.

4. Adapter device as claim 1 or 2, in which the conductive portion is located outside the metallic body.

5. Adapter device as in claim 1, in which the value of overall reactance of the adapter is modified by changing the thickness of at least the conductive portion.

6. Adapter device as in claim 1, in which the value of overall reactance of the adapter is modified by changing the length of at least the conductive portion.

7. Adapter device as in claim 1, in which the value of overall reactance of the adapter is modified by changing the diameter of bending of at least the conductive portion.

8. Adapter device as in claim 1, in which the value of overall reactance of the adapter is modified by changing the configuration of at least the conductive portion.

9. Adapter device as in claim 1, which includes attachment elements of a replaceable type for attachment to the relative electrode-holder arm.

10. Adapter device as in claim 1, in which a contact element of a replaceable type is included between the lower end part of the metallic body and the upper part of the graphite segment.

11. Adapter device as in claim 1, in which the graphite segment has its lateral surface not processed by machine.

12. In an electric arc furnace of a type fed with direct current or alternating current and comprising at least one secondary supply circuit which connects a transformer to one or more electrode-holder arms, the improvement comprising an adaptor having a function of auxiliary reactance, the adapter comprising a hollow cylindrical metallic body associated with the relative electrode-holder arm and directed towards an inside of the furnace, the metallic body being connected at its lower end to a graphite segment directed towards a bath of molten metal inside the furnace, wherein at least part of the adapter includes a conductive portion made of a material with a high electric conductivity which is solidly associated and substantially coaxial with the metallic body, a surface of the conductive portion being dimensioned according to a desired value of overall reactance of the secondary circuit of the furnace.

13. Electric arc furnace as in claim 12, in which at least part of the adapter comprises a bimetallic plate in iron-copper defining respectively the substantially coaxially arranged metallic body and conductive portion.

14. Electric arc furnace as in claim 12, in which the conductive portion is located inside the metallic body.

15. Electric arc furnace as in claim 12, in which the conductive portion is located outside the metallic body.

16. Electric arc furnace as in claim 12, in which the value of overall reactance of the adapter is modified by changing the thickness of at least the conductive portion.

17. Electric arc furnace as in claim 12, in which the value of the overall reactance of the adapter is modified by changing the length of at least the conductive portion.

18. Electric arc furnace as in claim 12, in which the value of overall reactance of the adapter is modified by changing the diameter of bending of at least the conductive portion.

19. Electric arc furnace as in claim 12, in which the value of overall reactance of the adapter is modified by changing the configuration of at least the conductive portion.

20. Electric arc furnace as in claim 12, which includes attachment elements of a replaceable type for attachment to the relative electrode-holder arm.

21. Electric arc furnace as in claim 12, in which a contact element of a replaceable type is included between the lower end part of the metallic body and the upper part of the graphite segment.

22. Electric arc furnace as in claim 12, in which the graphite segment has its lateral surface not processed by machine.

* * * * *